US005634569A

United States Patent [19]

DeCoster

[11] Patent Number: 5,634,569

[45] Date of Patent: Jun. 3, 1997

[54] FOOD CONTAINER WITH DISPENSING MEANS

[75] Inventor: Pieter K. J. DeCoster, Aalst, Belgium

[73] Assignee: Dart Industries Inc., Orlando, Fla.

[21] Appl. No.: 576,057

[22] Filed: Jan. 18, 1996

[51] Int. Cl.[6] ..... B65D 25/38

[52] U.S. Cl. ..... 220/735; 220/410; 220/23.83; 220/771; 206/804; 206/519

[58] Field of Search ..... 206/804, 514, 206/519, 507; 215/391; 220/574.1, 409, 410, 23.83, 23.86, 735, 771

[56] References Cited

U.S. PATENT DOCUMENTS

| | | | |
|---|---|---|---|
| D. 257,201 | 10/1980 | Croyle et al. . | |
| D. 301,295 | 5/1989 | Gilliard . | |
| D. 328,014 | 7/1992 | DeCoster et al. . | |
| D. 333,757 | 3/1993 | DeCoster . | |
| 277,467 | 5/1883 | Quilfeldt . | |
| 646,135 | 3/1900 | Smith . | |
| 1,906,593 | 5/1933 | Higgins | 220/409 |
| 2,175,735 | 10/1939 | Banks | 220/735 |
| 2,252,381 | 8/1941 | Ladd | 206/804 |
| 2,904,205 | 9/1959 | Callery . | |
| 2,983,369 | 5/1961 | Rogovin . | |
| 3,249,250 | 5/1966 | McKee . | |
| 3,363,794 | 1/1968 | Dearing | 215/391 |
| 3,380,592 | 4/1968 | Arnold . | |
| 3,416,689 | 12/1968 | Greenfield . | |
| 4,027,796 | 6/1977 | Martin | 206/507 |
| 4,179,040 | 12/1979 | Bateman et al. . | |
| 5,071,008 | 12/1991 | Hradisky | 206/507 |
| 5,082,135 | 1/1992 | DeCoster . | |

FOREIGN PATENT DOCUMENTS

| | | | |
|---|---|---|---|
| 623430 | 2/1963 | Belgium . | |
| 2243819 | 11/1991 | United Kingdom | 206/804 |

OTHER PUBLICATIONS

Goldschmiede Zeitung, Aug. 1983, p. 6.

*Primary Examiner*—Stephen J. Castellano
*Attorney, Agent, or Firm*—John A. Doninger

[57] ABSTRACT

A container including an internal carrier vertically positionable in a receptacle, guided by vertical ribs in the receptacle, and manually moved by a central handle on the carrier. The handle is hollow and releasably receives a food gripping fork.

13 Claims, 5 Drawing Sheets

FOOD CONTAINER WITH DISPENSING MEANS

BACKGROUND OF THE INVENTION

The invention relates to a container for use in the storing and dispensing of foodstuffs wherein the foodstuff normally comprises multiple relatively small items which are preferably individually dispensed. Examples of such foodstuffs include pickles, olives, pickled onions, cocktail sausages, cheese pieces, vegetable and fruit pieces, and the like.

Examples of such containers will be noted in the following two patents, commonly owned with the present application:

| U.S. Pat. No. | Inventor |
|---|---|
| 4,179,040 | Bateman et al |
| 5,082,135 | DeCoster |

In each instance a vertically moveable insert is provided to elevate the foodstuff to the open upper mouth of the container to facilitate access thereto. In addition, the elevation of the foodstuff tends to remove the foodstuff from any preservative liquid or the like in the container. In DeCoster, the elevated tray, upon a slight rotation thereof relative to the receptacle, is supported in an upper dispensing position.

SUMMARY OF THE INVENTION

The container of the present invention, while intended for use generally in the manner of the above referred to patented containers, incorporates features which uniquely enhance its practicability. In this regard, it is intended that the container be capable of accommodating larger foodstuffs and/or larger quantities of foodstuff both by making the container itself with a greater internal volume, and by providing means for properly containing and providing access to the larger volume of contents. This includes the provision of a vertically moveable internal insert or carrier with a high peripheral wall and a single central stem handle which in turn mounts a removable fork or fork-like implement for selective use in removing individual foods, food slices, and the like.

In further improving the practability of the container of the invention, it is desirable that the container be attractive in appearance, easily handled and readily acceptable as a serving container or bowl on the dinner table.

Basically, the container comprises an upwardly opening generally cylindrical receptacle, a vertically shiftable walled insert or carrier within the receptacle movable from a fully inserted position for maximizing the usable internal volume of the container to a stable elevated position for facilitating access to the contents of the container, and an implement for removing individual items. The implement, when not in use, is telescopically stored within the single central stem handle of the carrier.

The internal carrier includes a bottom approximately coextensive with the bottom of the container and directly engageable thereon in the fully inserted position of the carrier. The carrier bottom includes apertures therethrough which allow for the drainage of any liquids from the foodstuff as the carrier is elevated. The actual handling of the carrier is effected by a central vertically extending hollow stem having opposed finger grip recesses. The carrier further includes a peripheral wall of a height equal to approximately one-half the height of the container whereby foodstuffs on and within the carrier are properly retained. The carrier wall includes a series of vertical recesses formed therein which slidably engage a similar series of vertical ribs extending inward of the interior surface of the receptacle wall so as to provide a guide means for a vertical lifting of the carrier. The ribs terminate in upper shoulders which, upon an elevation of the carrier thereabove and a rotation of the carrier relative to the receptacle, support the carrier in an elevated position.

The dispensing implement is elongate and has a pair of piercing and/or gripping prongs on the lower end thereof. The upper end of the implement has a generally planar transverse head, the opposed sides of which are received within diametrically opposed vertical slots in the upper portion of the stem handle for both limiting the downward movement of the implement within the handle and for allowing the handle and implement to rotate as a unit.

Other features and advantages of the invention will become apparent from the more detailed description of the invention following hereinafter.

DESCRIPTION OF PREFERRED EMBODIMENT

Figure 1:
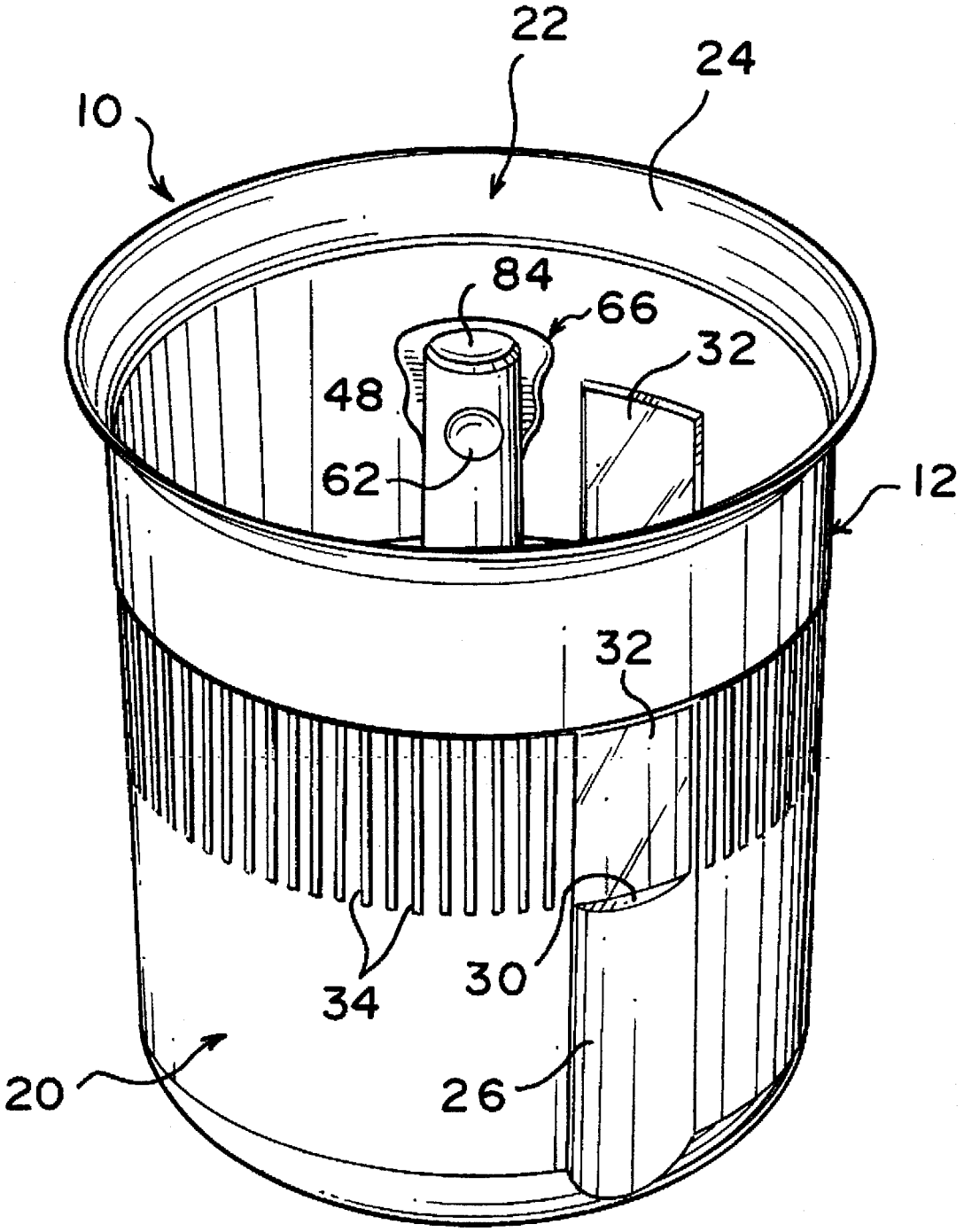
FIG. 1 is a perspective view of the container comprising the invention.
Figure 3:
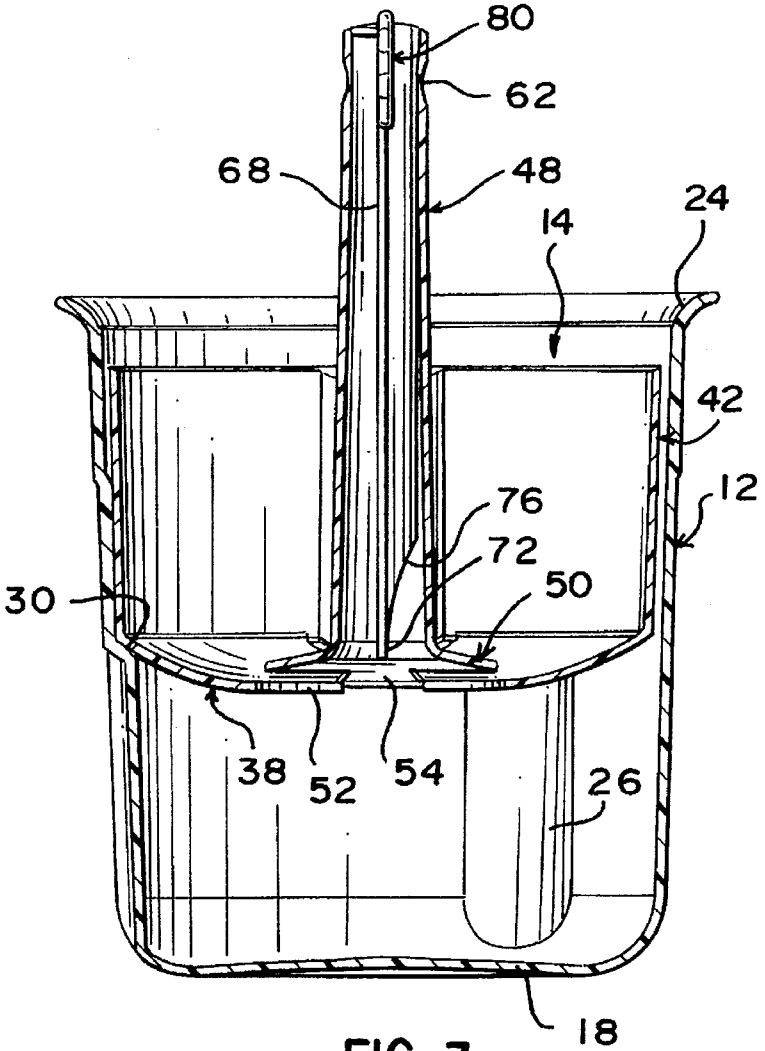
FIG. 3 is a cross-sectional view similar to FIG. 2 with the carrier elevated and partially rotated into supported position on the receptacle ribs.

Referring now more specifically to the drawings, the container 10 includes a receptacle 12, a carrier insert 14 and a food-handling utensil or implement 16. The carrier and implement combine to provide means for facilitating the dispensing of the contents of the container.

The receptacle 12 is cylindrical and includes a slightly upwardly concave, generally planar bottom 18, a peripheral wall 20 integral with the periphery of the bottom 18 and extending vertically upward therefrom, and an open top 22 defined by an outwardly flared upper rim portion 24. The peripheral wall 20 of the receptacle has the circular cross-section thereof constant or slightly outwardly tapering upwardly for the vertical height thereof for vertical sliding manipulation of the carrier 14 within the interior of the receptacle as shall be described subsequently.

The peripheral wall 20, at three equally spaced points thereabout, is provided with inwardly formed portions defining three vertically extending internal ribs 26 extending from the bottom 18 to approximately one-half of the height of the receptacle 12. These vertical ribs 26 have smooth constant cross-sections throughout the height thereof, preferably arcuate as illustrated, and terminate at the upper ends thereof in planar shoulders 30 which extend into the interior of the receptacle at a slight downward inclination. These ribs function as guides for the vertical movement of the internal carrier 14, the shoulders 30 functioning as supports for the carrier when elevated to approximately mid-height within the receptacle.

Figure 4:
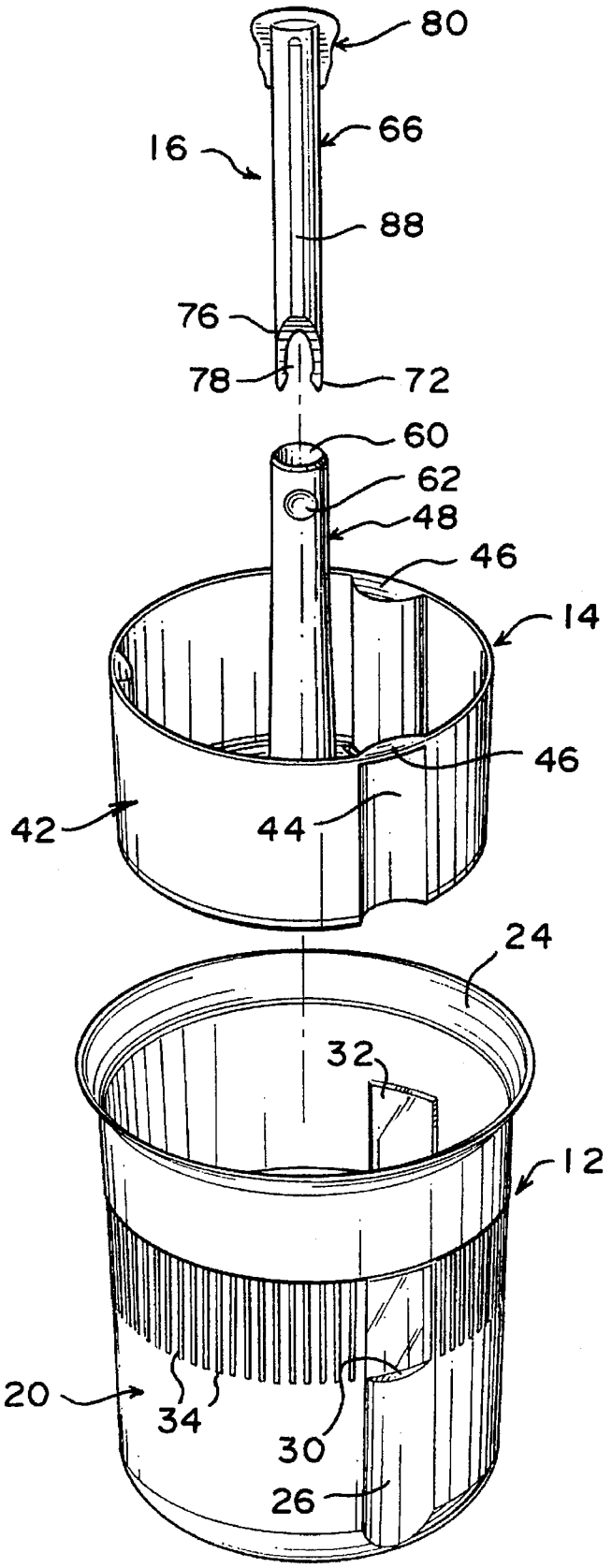
FIG. 4 is an exploded perspective view of the three components of the container.
Figure 5:
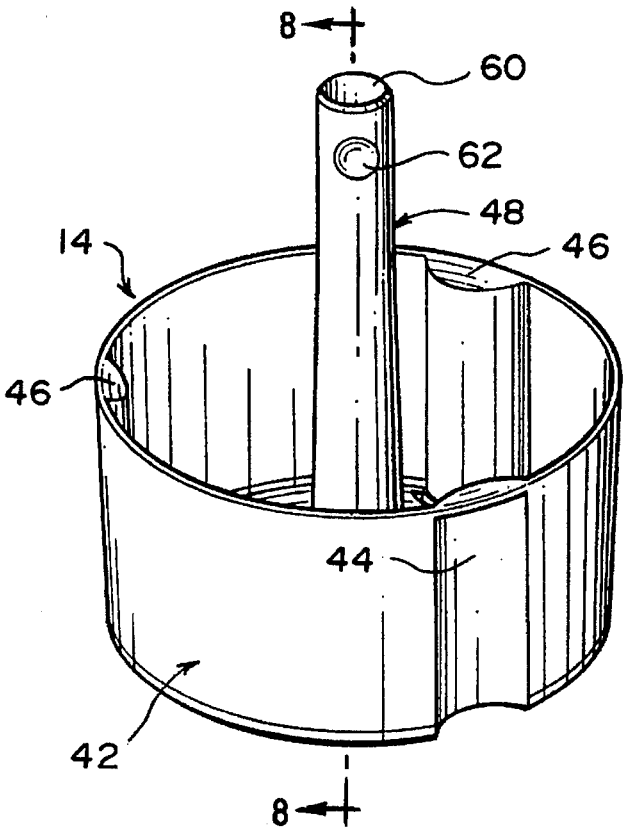
FIG. 5 is a perspective view of the carrier itself.
Figure 6:
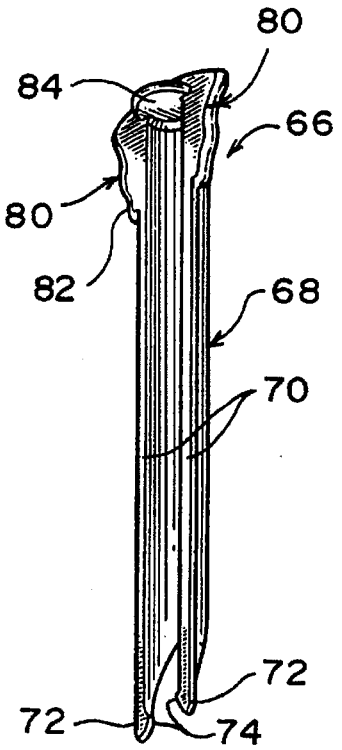
FIG. 6 is a perspective view of the fork-like implement.
Figure 7:
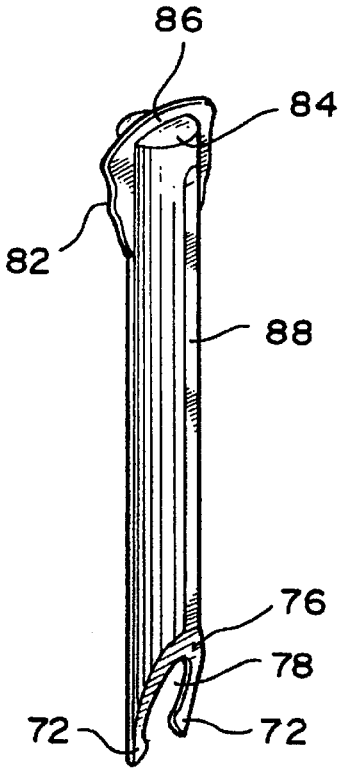
FIG. 7 is a further perspective view of the implement.
Figure 8:
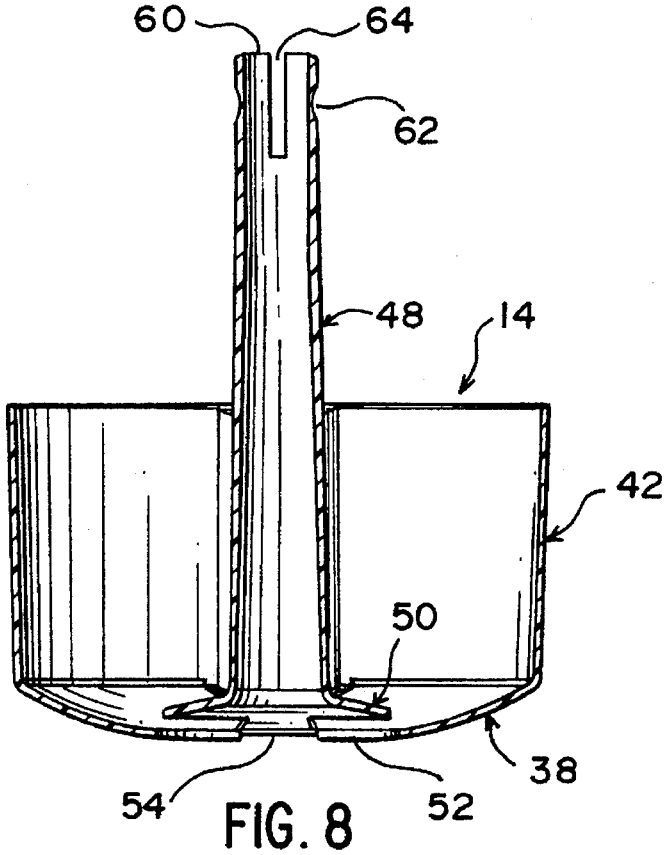
FIG. 8 is a cross-sectional view through the carrier taken substantially on a plane passing along line 8—8 in FIG. 5.
Figure 9:
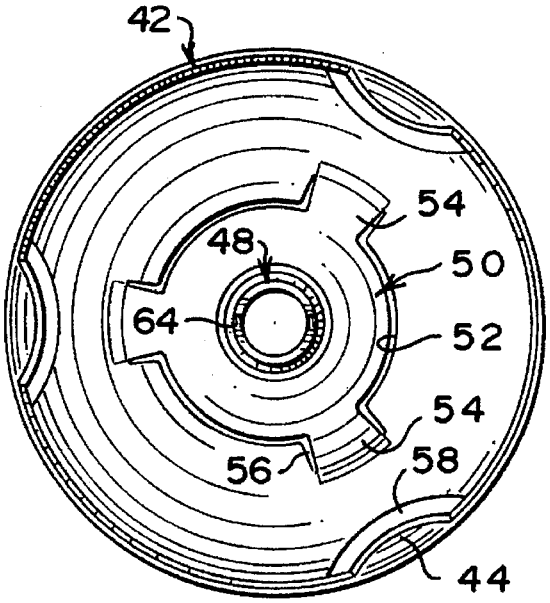
FIG. 9 is a top plan view of the carrier.

Immediately above each rib 26, and the corresponding external vertical recess formed thereby, the receptacle wall 20 includes a vertically elongate transparent viewing panel or window 32 extending for approximately one-half of the remaining height of the receptacle 12. Noting FIGS. 1 and 4 in particular, the receptacle wall 20, peripherally thereabout and at equal height with the panels 32, is provided with a series of spaced vertical stripes 34 of a differing surface presentation, transparency or the like, providing a distinctive presentation. The peripheral wall 20 immediately above the level of the panels 32 presents a smooth band, the outer surface of which is slightly outwardly offset, as at 36, with the band also of a distinctive surface appearance, for example slightly frosted.

The carrier 14 is cylindrical and configured for close reception within the receptacle while being freely vertically slidable relative thereto. The carrier 14 includes a bottom support tray 38 of a downwardly generally convex configuration which, noting FIG. 2 in particular, seats on the bottom 18 of the receptacle 12 with an annular fluid-accommodating space 40 defined therebetween at the outer peripheries in light of the greater curvature of the tray 38 relative to the receptacle bottom 18. The carrier further includes a substantially cylindrical peripheral wall 42 integral with the periphery of the tray 38 and extending upwardly therefrom to define an upwardly opening chamber. The combined height of the wall 42 and tray 38 is approximately one-half the height of the receptacle 12.

The peripheral carrier wall 42 includes three equally spaced vertically elongate, outwardly directly recesses 44 defined therein. The recesses are configured to conform to and slidably receive the receptacle wall ribs 26 and thus, in the illustrated embodiment, are arcuate in cross-section. Each of the recesses 44 extends upwardly through the peripheral edge portion of the bottom tray 38 for the full height of the peripheral wall 42 other than for a flat overlying top panel 46 slightly downward and inwardly inclined to conform to the top shoulder 30 of a receptacle wall rib 26. As will be appreciated from the drawings, the recesses 44 in the peripheral wall 42 form corresponding inwardly directed arcuate ribs. This is preferred to actually forming the recesses as depressions within a thicker wall, which would necessitate the use of additional material beyond what is necessary to provide the desired food-accommodating stability.

In its innermost or fully received position, the carrier 14, with the carrier recesses 44 aligned with the receptacle ribs 26, seats on the receptacle bottom 18 with the recess upper panels 46 seating on the upper shoulders 30 of the receptacle ribs 26. After the readily accessible goods from the upper portion of the container are removed, the carrier is vertically elevated to a dispensing position immediately above the receptacle ribs 26. In order to retain the carrier at this height, the carrier is slightly rotated to rotatably move the recesses 44 out of alignment with the ribs 26 whereby the peripheral edge portions of the carrier bottom 38, circumferentially away from the recesses 44, will rest on the upper inclined shoulders of the ribs 26, the slope of the carrier bottom 38 conforming to the inclination of these rib-formed shoulders 30.

Figure 10:
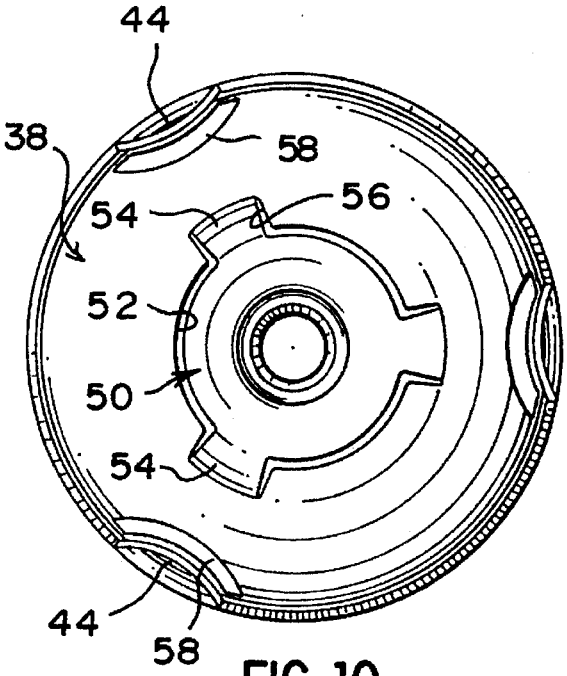
FIG. 10 is a bottom plane view of the carrier.

Vertical movement of the carrier 14, as well as the rotational manipulation thereof, is achieved using a central stem-like handle 48. The lower end of the stem 48 includes an integral dome-like base 50 overlying a substantially equal size central aperture 52 in the bottom 38 of the carrier 14. The base 50 is upwardly spaced from the bottom 38 and integrally formed therewith through radially extending bridge portions 54. As will be best noted from the bottom view of FIG. 10, the bridge portions, following the dome configuration of the base 50, extend beyond the circular opening 52 in the bottom 38 and integrally join the bottom 38 radially outward therefrom. The circular opening 52 is in turn provided with radial open branches 56, one underlying each bridge portion 54. So formed, the base 50 can be considered to be upwardly formed from the central portion of the carrier bottom 38 and integrally retained thereto by the outer edges of the bridge portions 54, thus providing drainage apertures peripherally about the outer edges of the base 50, including along the opposed side edges of each bridge portion 54. So located, and communicating with an open fluid accommodating chamber immediately below the raised base 50, the fluid within the carrier, upon a raising of the carrier, will flow freely through the bottom of the carrier and into the progressively increasing space between the upwardly moving carrier and the bottom of the receptacle. Similar drainage openings 58 are provided through the carrier bottom 38 at the base of each recess 44, or more particularly the vertical, radially inwardly directed projection or rib formed in defining the recess. Each opening 58 follows the arc of the recess and, positioned at the outer periphery of the carrier bottom 38, also allows for liquid drainage into the annular space 40 at the periphery of the carrier bottom 38 and the receptacle bottom 18.

It is significant that the drainage openings are elongate, relatively narrow, and at the relatively protected lower end portions of the recess forming projections and the handle base, thus precluding any possibility of foodstuffs being caught therein or moving therethrough. Similarly, in light of the sloping portions immediately adjacent the various drainage openings, there is no tendency for a clogging of these recesses as might prevent the desired drainage.

The stem handle 48, integral with the base 50, is hollow and tapers slightly upwardly from the base 50 to the open upper end 60 of the handle located at a height generally coextensive with the outwardly flaring receptacle rim 24 when the carrier 14 is fully seated within the receptacle. The upper section of the handle 48, at diametrically opposed positions, is provided with a pair of recesses 62 which receive the fingers of a user for a non-slip manipulation of the handle, and hence the carrier. It will be appreciated that the gripping recesses 62 are positioned for easy access thereto even within a filled receptacle. It will also be recognized that the use of a single central handle, in the nature of a vertical stem, allows for free access to the interior to the container completely thereabout, as compared to a bail handle which both restricts access from the side of the container and the top of the container.

The handle 48 is completed by a pair of vertical slots 64 diametrically opposed from each other and 90° removed from the recesses 62.

Removal of foodstuff, normally relatively small or awkward individual pieces, from pickle containers and the like, is usually facilitated by a fork or pick. The container 10 of the invention includes a dispensing implement 66 which is removable stored within the hollow handle 48 in a cooperative manner. The implement 66, which can be considered a two-prong fork, includes a vertically elongate body 68 semi-circular cross-section with transversely opposed flat elongate edges 70 which terminate in a pair of tapered depending prongs 72 having opposed inwardly directed gripping lugs 74. The vertically elongate body 68 is sharply upwardly beveled, as at 76, from the lower ends of the edges 70 to define an opening 78 between the lower portions of the edges 70 which in turn forms the prongs 72. It is contemplated that the prongs 72 be of sufficient rigidity as to appropriately "spear" the foodstuff for removal. Similarly, the prongs can have a slight degree of resilient flexibility to provide a gripping action.

The upper portion of the implement 66 includes a top cap 84 and is provided with a pair of laterally projecting coplanar wings or projections 80 which are generally in the plane of the forward vertical edges 70 and joined by an intermediate portion 86 extending diametrically across the cap 84. The projections include outer edges 82 with a wave-like configuration of alternating depressions and extensions to facilitate a grasping thereof.

The diameter of the fork implement 66, in the plane of the longitudinal edges 70 thereof, is such as to allow the implement to be closely although slidably received within the handle 48 through the open upper end 60 thereof. The projections 80, in turn, are received within the opposed handle slots 64 which are of a depth sufficient to receive the projections 80 substantially fully therein with the top cap 84 of the implement body 68 aligned with and closing the upper end 60 of the handle 48. Once fully received within the opposed slots 64, the implement projections 80 can actually be used as an assist in rotating the carrier to and from its dispensing position above the receptacle ribs 26.

As the implement is to be closely received within the handle 48, the semi-cylindrical wall of the body 68, along the rear face thereof opposed from the plane of the forward edges 70, is provided with a substantially full height flat portion 88, forming a minor space between the implement and the inner surface of the handle 48 to avoid any tendency of the implement 68 jamming within the handle 48.

Figure 2:
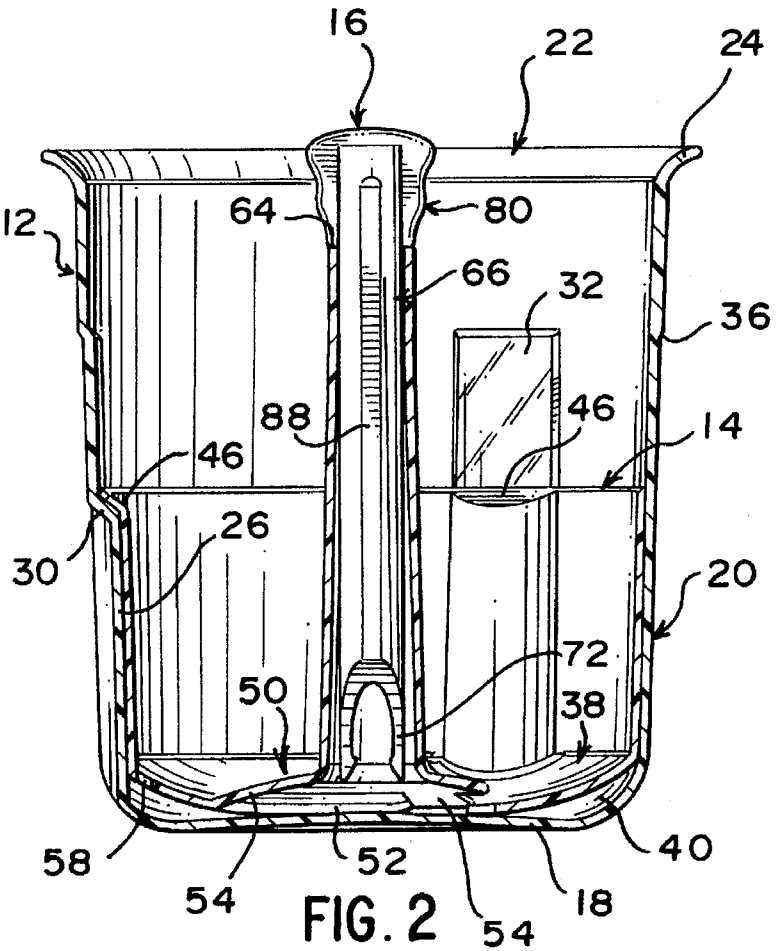
FIG. 2 is a vertical cross-section through the container with the carrier fully recessed therein and the implement seated within the handle.

As will be appreciated from FIGS. 1 and 2, the nested implement has the upper end generally aligned with or only very slightly above the upper edge of the receptacle 12. As such, there is no interference with the mounting of a removable lid over the receptacle. While no such lid has been illustrated, a lid for the container would preferably be configured in the manner of the lid in the above referred to DeCoster U.S. Pat. No. 5,082,135.

As will be recognized, the range of foodstuffs which can be accommodated in the container 10 is limited only by size, and can vary, as an example, from pickles or olives in a preservative, to cherries or food slices in an appropriate syrup. The components of the container, that is the receptacle, carrier and fork implement, are completely separable for cleaning purposes, and the receptacle itself is of an attractive appearance complementing tableware for use as a serving dish.

The foregoing is considered illustrative of the principals of the invention. As variations and modifications, within the parameters of the invention, may occur to those skilled in the art, it is not desired to limit the invention to the exact construction and manner of use specifically described.

I claim:

1. A food storing and dispensing container comprising a receptacle including a vertically extending peripheral wall, a closed bottom and an open top, said peripheral wall and bottom defining a receptacle interior, a carrier vertically slidable within said receptacle interior between a storage position adjacent said receptacle bottom and a dispensing position vertically spaced above said receptacle bottom, said carrier including a bottom and a handle affixed centrally to said carrier bottom and extending vertically therefrom, said handle being hollow and including an open upper end, and an implement for engaging and lifting foodstuff from said receptacle interior, said implement being slidably received within said hollow handle through the open upper end thereof, and means on said handle and said implement for limiting relative movement therebetween when said implement is received within said handle.

2. The container of claim 1 wherein said means comprises a pair of spaced slots in said handle extending downward from said open upper end thereof, said implement including an upper portion with laterally extending projections thereon received within said slots and extending laterally beyond said handle whereby relative rotation between said implement and said handle is precluded.

3. The container of claim 2 wherein said implement includes a lower end portion with longitudinally extending prongs defined thereon, said implement, upward from said prongs, having a substantially semi-circular cross-section.

4. A combined storage and dispensing container for food, said container comprising a receptacle including a vertically extending peripheral wall, a closed bottom and an open top, said peripheral wall and bottom defining a receptacle interior, an insert carrier vertically slidable within said receptacle interior between a storage position adjacent said receptacle bottom and a dispensing position vertically spaced above said receptacle bottom, said carrier including a bottom, a peripheral wall fixed to said carrier bottom and extending upward therefrom and defining an upwardly opening chamber, and a handle affixed to and extending vertically from said carrier bottom, shoulder means on said receptacle wall inwardly directed into said receptacle interior and in vertically spaced relation above said receptacle bottom for selectively receiving said carrier bottom thereon and supporting said carrier in said dispensing position vertically spaced above said receptacle bottom, said handle being hollow and terminating in an open upper end, and a food gripping utensil slidably and removably received within a stored position in said handle through said open upper end, said handle, adjacent said open upper end, including a pair of slots vertically defined therein and opening upward, said utensil including a pair of laterally extending projections vertically receivable within said slots for a fixed positioning and a cooperative retention of said utensil in said handle.

5. A combined storage and dispensing container for food, said container comprising a receptacle including a vertically extending peripheral wall, a closed bottom and an open top, said peripheral wall and bottom defining a receptacle interior, an insert carrier vertically slidable within said receptacle interior between a storage position adjacent said receptacle bottom and a dispensing position vertically spaced above said receptacle bottom, said carrier including a bottom, a peripheral wall fixed to said carrier bottom and extending upward therefrom and defining an upwardly opening chamber, and a handle affixed to and extending vertically from said carrier bottom, shoulder means on said receptacle wall inwardly directed into said receptacle interior and in vertically spaced relation above said receptacle bottom for selectively receiving said carrier bottom thereon and supporting said carrier in said dispensing position vertically spaced above said receptacle bottom, guide means on said receptacle and carrier for stabilizing and guiding said carrier during movement of said carrier from said receptacle bottom to said dispensing position, said carrier, above said shoulder means, being rotatable relative to said receptacle for supporting engagement of said carrier bottom on said shoulder means, said guide means comprising a plurality of vertically extending ribs on said receptacle wall protecting into the interior of said receptacle, said carrier wall having recesses therein receiving said ribs and providing guided sliding movement between said carrier and said receptacle along the vertical extent of said ribs, said recess-received ribs precluding rotation of said carrier relative to said receptacle, said ribs terminate in upper ends defining said shoulder means, said carrier bottom to each side of each of said recesses extending radially beyond said recesses and engageable on said shoulder means upon rotation of said carrier above said shoulder means, said receptacle wall including a transparent window therein vertically above each of said ribs.

6. The container of claim 5 wherein said rib upper ends are at approximately one-half the height of said receptacle, said carrier wall, in said storage position, extending to approximately one-half the height of said receptacle wherein the transparent windows extend above said carrier wall in said storage position.

7. A combined storage and dispensing container for food, said container comprising a receptacle including a vertically extending peripheral wall, a closed bottom and an open top, said peripheral wall and bottom defining a receptacle interior, an insert carrier vertically slidable within said receptacle interior between a storage position adjacent said receptacle bottom and a dispensing position vertically spaced above said receptacle bottom, said carrier including a bottom, a peripheral wall fixed to said carrier bottom and extending upward therefrom and defining an upwardly opening chamber, and a handle affixed to and extending vertically from said carrier bottom, shoulder means on said receptacle wall inwardly directed into said receptacle interior and in vertically spaced relation above said receptacle bottom for selectively receiving said carrier bottom thereon and supporting said carrier in said dispensing position vertically spaced above said receptacle bottom, guide means on said receptacle and carrier for stabilizing and guiding said carrier during movement of said carrier from said receptacle bottom to said dispensing position, said carrier, above said shoulder means, being rotatable relative to said receptacle for supporting engagement of said carrier bottom on said shoulder means, said guide means comprising a plurality of vertically extending ribs on said receptacle wall protecting into the interior of said receptacle, said carrier wall having recesses therein receiving said ribs and providing guided sliding movement between said carrier and said receptacle along the vertical extent of said ribs, said recess-received ribs precluding rotation of said carrier relative to said receptacle, said ribs terminating in upper ends defining said shoulder means, said carrier bottom to each side of each of said recesses extending radially beyond said recesses and engageable on said shoulder means upon rotation of said carrier above said shoulder means, said handle being centrally fixed to said carrier bottom and extends upwardly therefrom beyond said carrier wall centrally therein, said handle terminating in an upper portion with a manually grippable exterior, and drainage apertures through said carrier bottom centrally about said handle, said handle including an upwardly domed base, said drainage apertures being defined below said domed base with said domed base rigidly engaged with said receptacle bottom radially outward of said drainage apertures by a plurality of radially extending bridging portions on said base which retain a central portion of said base above said receptacle bottom.

8. The container of claim 7 including additional drainage apertures peripherally about said carrier bottom and radially aligned immediately inward of said recesses.

9. The container of claim 8 wherein said receptacle bottom is upwardly convex and said carrier bottom is downwardly convex whereby an annular space is defined between said bottoms with said carrier in its storage position.

10. A combined storage and dispensing container for food, said container comprising a receptacle including a vertically extending peripheral wall, a closed bottom and an open top, said peripheral wall and bottom defining a receptacle interior, an insert carrier vertically slidable within said receptacle interior between a storage position adjacent said receptacle bottom and a dispensing position vertically spaced above said receptacle bottom, said carrier including a bottom, a peripheral wall fixed to said carrier bottom and extending upward therefrom and defining an upwardly opening chamber, and a handle affixed to and extending vertically from said carrier bottom, shoulder means on said receptacle wall inwardly directed into said receptacle interior and in vertically spaced relation above said receptacle bottom for selectively receiving said carrier bottom thereon and supporting said carrier in said dispensing position vertically spaced above said receptacle bottom, guide means on said receptacle and carrier for stabilizing and guiding said carrier during movement of said carrier from said receptacle bottom to said dispensing position, said carrier, above said shoulder means, being rotatable relative to said receptacle for supporting engagement of said carrier bottom on said shoulder means, said guide means comprising a plurality of vertically extending ribs on said receptacle wall protecting into the interior of said receptacle, said carrier wall having recesses therein receiving said ribs and providing guided sliding movement between said carrier and said receptacle along the vertical extent of said ribs, said recess-received ribs precluding rotation of said carrier relative to said receptacle, said ribs terminating in upper ends defining said shoulder means, said carrier bottom to each side of each of said recesses extending radially beyond said recesses and engageable on said shoulder means upon rotation of said carrier above said shoulder means, said handle being centrally fixed to said carrier bottom and extends upwardly therefrom beyond said carrier wall centrally therein, said handle terminating in an upper portion with a manually grippable exterior, and drainage apertures through said carrier bottom centrally about said handle, said handle being hollow and opening upwardly through an open upper end, and a food-picking implement vertically received within said handle through said open upper end thereof and removably retained therein.

11. The container of claim 10 wherein said handle, at the upper portion thereof, includes diametrically opposed vertical slots extending downward from said open upper end, said implement having an upper end portion with diametrically opposed generally planar projections slidably receivable within said slots for a fixed positioning of said implement within said handle.

12. The container of claim 11 wherein said implement includes a lower end portion and is of a constant semicircular cross-section for at least a major portion of the height thereof from said lower end portion toward said upper end portion thereof, said lower end portion being bevelled and defining a pair of longitudinally extending gripping prongs.

13. The container of claim 11 wherein said manually grippable exterior of said upper portion of said handle, at opposed points circumferentially removed from said slots, includes finger-accommodating recesses for facilitating the manipulation of said handle and said carrier.

* * * * *